US006374523B1

(12) United States Patent
Smith

(10) Patent No.: US 6,374,523 B1
(45) Date of Patent: Apr. 23, 2002

(54) HOLDER FOR MOUNTING TO A SURFACE AND INTERCHANGEABLY DISPLAYING A SHEET OF MATERIAL

(76) Inventor: Richard Smith, 99 Farrell St., Long Beach, NY (US) 11561

( * ) Notice: Subject to any disclaimer, the term of this patent is extended or adjusted under 35 U.S.C. 154(b) by 49 days.

(21) Appl. No.: 09/713,285

(22) Filed: Jul. 5, 2000

(51) Int. Cl.[7] ..... G09F 7/02; G09F 7/12
(52) U.S. Cl. ..... 40/611; 40/594; 40/765
(58) Field of Search ..... 40/594, 611, 649, 40/651, 661, 765, 776, 760

(56) References Cited

U.S. PATENT DOCUMENTS

| | | | | | |
|---|---|---|---|---|---|
| 1,894,803 | A | * | 1/1933 | Wahlstrom | 40/765 X |
| 2,176,535 | A | * | 10/1939 | Markoff | 40/725 X |
| 3,142,920 | A | * | 8/1964 | Nelson et al. | 40/649 X |
| 3,293,779 | A | * | 12/1966 | Vogeli, Sr. | 40/651 X |
| 4,144,664 | A | | 3/1979 | De Korte | 40/609 |
| 5,018,291 | A | | 5/1991 | Pasquale et al. | |
| 5,077,925 | A | * | 1/1992 | Herrera et al. | 40/611 X |
| 5,189,822 | A | * | 3/1993 | Schmanki et al. | 40/611 |
| 5,237,763 | A | * | 8/1993 | Ochoa | 40/765 X |
| 5,365,683 | A | | 11/1994 | Borja | |
| 5,419,134 | A | | 5/1995 | Gibson | 40/606 |
| 5,987,794 | A | | 11/1999 | Lavi et al. | 40/611 |
| 6,006,459 | A | * | 12/1999 | Kosmach | 40/661 X |

* cited by examiner

*Primary Examiner*—Brian K. Green
(74) *Attorney, Agent, or Firm*—Richard L. Miller

(57) ABSTRACT

A holder that mounts to a surface and interchangeably displays a sheet of material. The holder includes a back plate that is vertically mounted to the surface and holds the sheet of material and a front plate that is replaceably mounted to the back plate and sandwiches the sheet of material therebetween. The back plate has a border element that is substantially U-shaped and has vertical portions with channels therein that hold the front plate and the sheet of material, and a slot that is substantially U-shaped and prevents distortion during molding thereof. The front plate is transparent so as to allow the sheet of material to be visible therethrough and has a pair of vertical edges with shoulders thereon that engage in the channels in the back plate, respectively. The sheet of material is slid into the back plate and the front plate is slid into the back plate, by virtue of the shoulders of the front plate sliding in the channels in the back plate, and captures the sheet of material therebetween.

16 Claims, 1 Drawing Sheet

HOLDER FOR MOUNTING TO A SURFACE AND INTERCHANGEABLY DISPLAYING A SHEET OF MATERIAL

BACKGROUND OF THE INVENTION

1. Field of the Invention

The present invention relates to holder. More particularly the present invention relates to a holder for mounting to a surface and for interchangeably displacing a sheet of material.

2. Description of the Prior Art

Numerous innovations for display devices have been provided in the prior art that will be described. Even though these innovations may be suitable for the specific individual purposes to which they address, however, they differ from the present invention.

A FIRST EXAMPLE, U.S. Pat. No. 4,144,664 to De Korte teaches a weatherproof display device for changeable display signs to be mounted on a gasoline dispensing pump comprising a transparent weatherproof cover for holding changeable printed display cards depicting the prices and taxes applicable to the gasoline being dispensed. The device includes a thin rectangular box assembly formed by interlocking front and back panels made of a transparent material having a base assembly forming a mounting pedestal and a secured cap forming its top edge and serving as it cover. Insertion and withdrawal of the price display cards is accomplished by lifting the thin rectangular box assembly from its mounting pedestal base assembly, each of which is printed permanently with a specific set of price and tax conditions. The dimensions of each display card conform substantially to the height and width of the transparent panels, and are duplicated so as to be visible from each side. Several display cards, indicating various combinations of prices and taxes, and combined in a booklet form, may be stored safely within the display box, readily available for rearrangement as desired. The display unit may be disassembled rapidly for cleaning purposes.

A SECOND EXAMPLE, U.S. Pat. No. 5,018,291 to Pasquale et al. teaches a holder for displaying a printed sheet on a support wall such as the front face of a vertical machine that includes a back plate and a cover plate. The back plate and the cover plate can be assembled together in a snapfit relationship and the cover plate can be subsequently removed from the back plate. The back plate can be secured to the support wall. The back plate has a front face and a channel formed around the perimeter thereof. The channel rigidifies the back plate and serves to space the back plate from the wall. The cover plate includes a flange which extends around substantially the entire perimeter of the cover plate. The cover plate further includes an inner surface which can be placed adjacent the front face to maintain the printed sheet in a flat position within the display holder.

A THIRD EXAMPLE, U.S. Pat. No. 5,365,683 to Borja teaches a sports card display stand that includes a platform-like base, at least a pair of support posts mounted upright and laterally-spaced apart on the base, a longitudinal groove extending between upper and lower ends of each support post, and facing toward one another for slidably receiving an article holder in the form of a flat plastic sleeve containing a sports card or photo between each pair of the posts with opposite longitudinal edges of the sleeve extending within the grooves, and an elongated narrow top cap member having spaced cavities and a longitudinal channel extending between and intersecting with e cavities being recessed in an underside of the top cap member for receiving in a releasable mated relationship the upper ends of the support posts and the upper edge of the flat plastic sleeve in order to removable amount the top cap member onto the upper ends of me support posts. In such arrangement, the top cap member, base and support posts together form a frame which completely encloses the periphery of the flat plastic sleeve containing the sports card or photo. Removal of the top cap member from the posts permits withdrawal and replacement of the flat plastic sleeve containing the sports card or photo from and into the grooves of the posts.

A FOURTH EXAMPLE, U.S. Pat. No. 5,419,134 to Gibson teaches a display holder that is formed from a main frame member that is a single extrusion. The main frame member includes opposite edge frame portions and a center panel. Frame portions snap onto the ends of a center panel to complete a frame that extends entirely about the periphery of the display holder. The display holder may be mounted by a mounting member which includes a hinge strip. Hinge strip and a pair of mounting member flanges may be made by a co-extrusion process. A rigid structural plastic is used to form the flanges. A bendable, resilient plastic is used to form the hinge strip. The hinge strip will bend in response to a side force applied to the display holder. Hinge strip will act as a spring and will swing the display holder back to its at rest position when the force is removed. A mounting member may be use which includes a longitudinally split, tubular rib, with trunnions inserted into the end portions of the rib. These trunnions may extend through aligned openings and mount the display holder for pivotal movement about a vertical axis. A plurality of display holders may be mounted close together by use of the trunnions and the openings.

A FIFTH EXAMPLE, U.S. Pat. No. 5,987,794 to Lavi et al. teaches a frame structure that displays media and includes a support member, a frame housing and at least one interchangeable cartridge insert. The frame housing is supported by the support member and has at least one display opening for displaying the media. The frame housing also has at least one generic guide on the interior of the frame housing. The at least one interchangeable cartridge insert is adapted to fit in and be supported by the at least one genetic guide of the frame housing of the frame structure. The interchangeable cartridge insert includes at least one rail member and a media support panel. The at least one rail member has rails that are adapted to engage with the at least one generic guide of the frame structure. The at least one rail member also has media supports for supporting the media support panel. The media support panel is selected from a plurality of different media display format structures and different thicknesses, such as Styrofoam, cardboard, paperboard, a black board, white board, magnetic boards, an electric powered display media, a Styrofoam panel laminated with paper, and the like to display the media. In addition, the media supports of the at least one rail member are coupled to and support the media support panel in the frame structure. The interchangeable cartridge insert can further include at least one clip that is coupled to and supported by the at least one rail member to support additional media along with the media support panel. The support member is a base or a wall mount. The frame housing also includes a door that allows the interchangeable cartridge insert to inserted and removed from the frame housing of the frame structure.

It is apparent that numerous innovations for display devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a holder for mounting to a surface and for interchangeably displaying a sheet of material that avoids the disadvantages of the prior art.

ANOTHER OBJECT of the present invention is to provide a holder for mounting to a surface and for interchangeably displaying a sheet of material that is simple and inexpensive to manufacture.

STILL ANOTHER OBJECT of the present invention is to provide a holder for mounting to a surface and for interchangeably displaying a sheet of material that is simple to use.

BRIEFLY STATED, YET ANOTHER OBJECT of tho present invention is to provide a holder that mounts to a surface and interchangeably displays a sheet of material. The holder includes a back plate that is vertically mounted to the surface and holds the sheet of material and a front plate that is replacebly mounted to the back plate and sandwiches the sheet of material therebetween. The back plate has a border element that is substantially U-shaped and has vertical portions with channels therein that hold the front plate and the sheet of material, and a slot that is substantially U-shaped and prevents distortion during molding thereof. The front plate is transparent so as to allow the sheet of material to be visible therethrough and has a pair of vertical edges with shoulders thereon that engage in the channels in the back plate, respectively. The sheet of material is slid into the back plate and the front plate is slid into the back plate, by virtue of the shoulders of the front plate sliding in the channels in the back plate, and captures the sheet of material therebetween.

The novel features which are considered characteristic of the present invention are set forth in the appended claims. The invention itself, however, both as to its construction and its method of operation, together with, additional objects and advantages thereof, will be best understood from the following description of the specific embodiments when read and understood in connection with the accompanying drawing.

BRIEF DESCRIPTION OF THE DRAWINGS

The figures of the drawing are briefly described as follows.

LIST OF REFERENCE NUMERALS UTILIZED IN THE DRAWING

Figure 1:
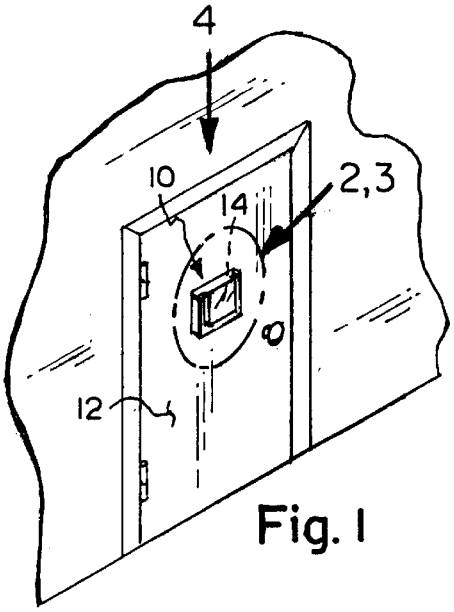
FIG. 1 is a diagrammatic perspective view of the present invention in use.
Figure 2:
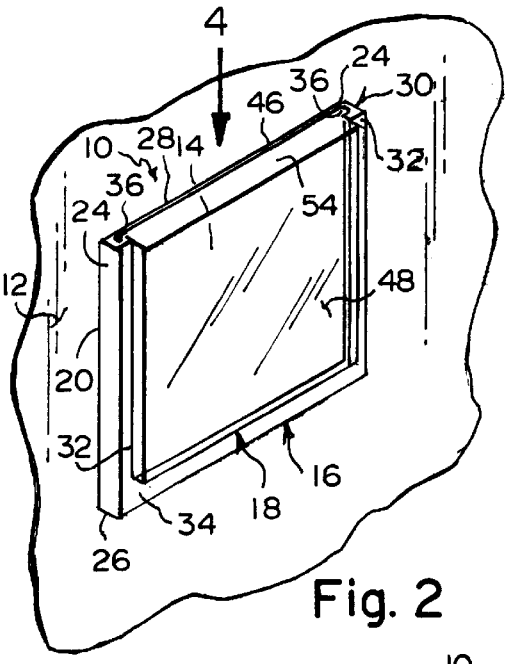
FIG. 2 is an enlarged diagrammatic perspective view of the area generally enclosed by the dotted curve identified by arrow 2 in FIG. 1 of the present invention.
Figure 4:
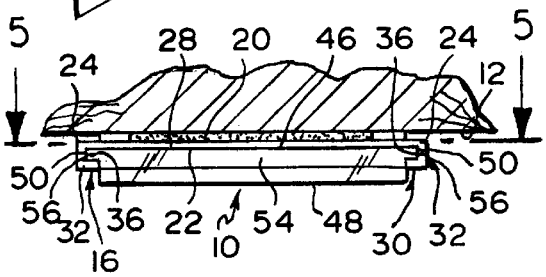
FIG. 4 is a diagrammatic top plan view taken generally in the direction of arrow 4 in FIGS. 1 and 2.
Figure 5:
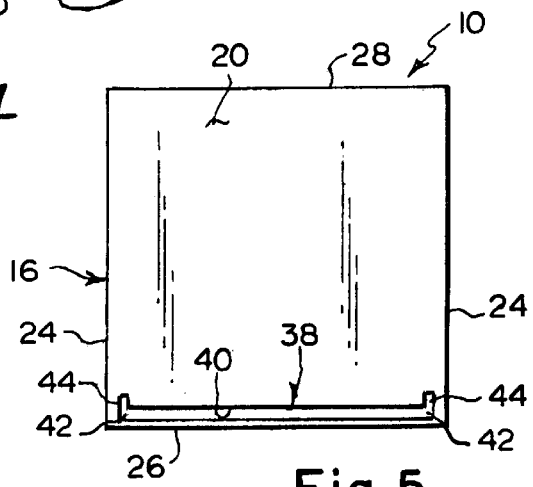
FIG. 5 is a diagrammatic rear elevational view taken generally in the direction of line 5—5 in FIG. 4.
Figure 3:
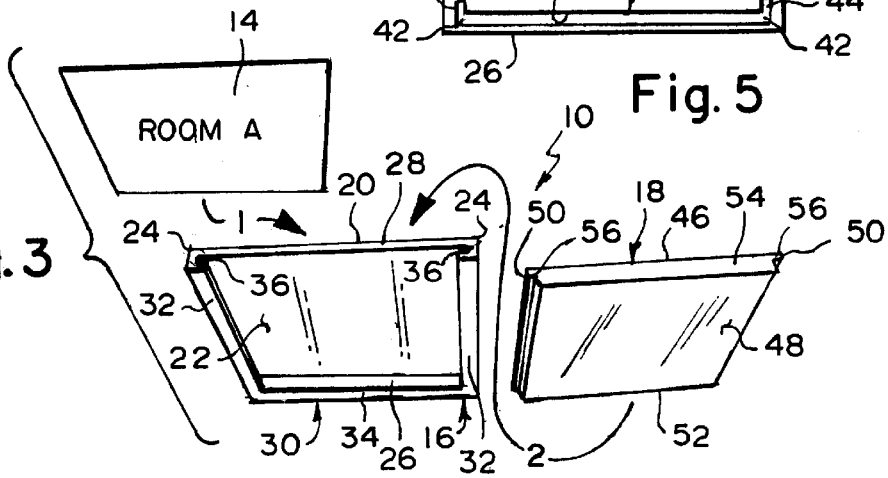
FIG. 3 is an exploded enlarged diagrammatic perspective view of the area generally enclosed by the dotted curve identified by arrow 3 in FIG. 1 of the present invention.

10 holder of present invention for mounting to surface 12 and for interchangeably displaying sheet of material 14

12 surface

14 sheet of material

16 back plate for vertical mounting to surface 12 and for holding sheet of material 14

18 front plate for sandwiching the sheet of material 14

20 rearwardmost surface of back plate 16 for facing surface 12

22 forwardmost surface of back plate 16

24 pair of vertical edges of back plate 16

26 lowermost horizontal edge of back plate 16

28 uppermost horizontal edge of back plate 16

30 border element of bask plate 16

32 pair of vertical portions of border element 30 of back plate 16

34 horizontal portion of border element 30 of back plate 16

36 channel in each vertical portion of pair of vertical portions 32 of border element 30 of back plate 30 for holding sheet of material 14

38 slot in back plate 16 for preventing distortion of back plate 16 during molding thereof

40 horizontal portion of slot 38 in back plate 16

42 pair of ends of horizontal portion 40 of slot 38 in back plate 16

44 pair of vertical portions of slot 38 in back plate 16

46 rearwardmost surface of front plate 18

48 forwardmost surface of front plate 18 for facing ambient

50 pair of vertical edges of front plate 18

52 lowermost horizontal edge of front plate 18

54 uppermost horizontal edge of front plate 18

56 shoulder on each vertical edge of pair of vertical edges of front plate 18

DETAILED DESCRIPTION OF THE PREFERRED EMBODIMENT

Referring now to the figures, in which like numerals indicate like parts, and particularly to FIG. 1, the holder of the present invention is shown generally at 10 for mounting to a surface 12 and for interchangeably displaying a sheet of material 14.

The configuration of the holder 10 can best be seen in FIGS. 2–5, and as such, will be discussed with reference thereto.

The holder 10 comprises a back plate 16 for vertical mounting to the surface 12 and for holding the sheet of material 14.

The holder 10 further comprises a front plate 18 that is replaceably mounted to the back plate 16 for sandwiching the sheet of material 14 therebetween.

The back plate 16 is flats thin, and generally square-shaped.

The back plate 16 has a rearwardmost surface 20 for facing the surface 12, a forwardmost surface 22 that faces the front plate 18, a pair of vertical edges 24 that are straight, a lowermost horizontal edge 26 that is straight, and an uppermost horizontal edge 28 that is straight.

The back plate 16 further has a border element 30 that is substantially U-shaped and is disposed on the forwardmost face 22 thereof.

The border element 30 of the back plate 16 has a pair of vertical portions 32 that are straight, have entire lengths, and extend forwardly and continuously along the pair of vertical edges 24 of the back plate 16, respectively, from the uppermost horizontal edge 28 of the back plate 16 to the lowermost horizontal edge 26 of the back plate 16.

The border element 30 of the back plate 16 further has a horizontal portion 34 that is straight and extends forwardly and continuously along the lowermost horizontal edge 26 of the back plate 16, from one vertical portion 32 thereof to the other vertical portion 32 thereof.

The horizontal portion 34 of the border element 30 is slender, elongated, and parallelepiped-shaped.

Each vertical portion 32 of the border element 30 is slender elongated, and parallelepiped-shaped.

Each vertical portion 32 of the border element 30 has channel 36 therein that is rectangular-parallelepiped-shaped and holds the front plate 18 and is for holding the sheet of material 14, and which extends the entire length thereof, is flush with the forwardmost surface 22 of the back plate 16, and faces, and is aligned with, the other channel 36.

The channel 36 in each vertical portion 32 of the border element 30 is open at the uppermost horizontal edge 28 of the back plate so as to allow insertion of the front plate 18 and for insertion of the sheet of material 14, until the horizontal portion 34 of the border element 30 which acts as a stop.

The back plate 16 further has a slot 38 that is substantially U-shaped, for preventing distortion of the back plate 16 during molding thereof.

The slot 38 in the back plate 16 has a horizontal portion 40 that is rectangular-parallelepiped-shaped, it disposed parallel to the lowermost horizontal edge 26 of the back plate 16 extends completely through the back plate 16 and partway into the horizontal portion 34 of the border element 30, and terminates in a pair of ends 42.

The slot 38 in the back plate 16 further has a pair of vertical portions 44 that are rectangular-parallelepiped-shaped, are disposed parallel to the pair of vertical edges 24 of the back plate 16, respectively, extend upwardly from the pair of ends 42 of the horizontal portion 40 thereof, respectively, completely through the back plate 16 and partway into the pair of vertical portions 32 of the border element 30, respectively, an communicate with the channel 36 in each vertical portion 32 of the border element 30, respectively.

The front plate 18 is flat, thin, generally square-shaped, and transparent for allowing the sheet of material 14 to be visible therethrough.

The front plate 18 has a rearwardmost surface 46 that faces the forwardmost surface 22 of the back plate 16, a forwardmost surface 48 that extends forwardly past the border element 30 of the back plate 16 for facing the ambient, a pair of vertical edges 50 that are straight, a lowermost horizontal edge 52 that is straight and abuts against the horizontal portion 34 of the border element 30 of the back plate 16, and an uppermost horizontal edge 54 that is straight and aligns with the uppermost horizontal edge 28 of the back plate 16.

Each vertical edge 50 of the front plate 18 has an entire length and a shoulder 56 thereon that engages in an associated channel 36 in the back plate 16, and which extends the entire length thereof, is flush with the rearwardmost surface 46 of the front plate 18 so as to allow the front plate 18 to lie flat on the back plate 16, and falls short of the forwardmost surface 48 of the front plate 18, wherein the sheet of material 14 is slid into the back plate 16 and the front plate 18 is slid into the back plate 16, by virtue of the shoulder on each vertical edge 50 of the front plate 18 sliding in the associated channel 36 in the back plate 16 and captures the sheet of material 14 therebetween.

The front plate 18 can be magnified, tinted, or the like.

It will be understood that each of the elements described above, or two or more together, may also find a useful application in other types of constructions differing from the types described above.

While the invention has been illustrated and described as embodied in a holder for mounting to a surface and for interchangeably displaying a sheet of material, however, it is not limited to the details shown, since it will be understood that various omissions, modifications, substitutions and changes in the forms and details of the device illustrated and its operation can be made by those skilled in tie art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A holder for mounting to a surface and for interchangeably displaying a sheet of material, said holder comprising;

a) a back plate for vertical mounting to the surface and for holding the sheet of material; and b) a front plate replaceably mounted to said back plate for sandwiching the sheet of material therebetween, wherein said back plate has:

A) a rearwardmost surface for facing the surface;

B) a forwardmost surface that faces said front plate;

C) a pair of vertical edges that are straight;

D) a lowermost horizontal edge that is straight; and

E) an uppermost horizontal edge that is straight, wherein said back plate further has a border element that is substantially U-shaped and is disposed on said forwardmost face thereof, wherein said border element of said back plate has a pair of vertical portions that are straight, have entire lengths, and extend forwardly and continuously along said pair of vertical edges of said back plate, respectively, from said uppermost horizontal edge of said back plate to said lowermost horizontal edge of said back plate, wherein said border element of said back plate further has a horizontal portion that is straight and extends forwardly and continuously along said lowermost horizontal edge of said back plate, from one vertical portion thereof to the other vertical portion thereof, wherein each vertical portion of said border element has a channel therein that is rectangular-parallelepiped-shaped and holds said front plate and is for holding the sheet of material, and which extends said entire length thereof, is flush with said forwardmost surface of said back plate, and faces, and is aligned with, the other channel, wherein said back plate further has a slot that is substantially U-shaped for preventing distortion of said back plate during molding thereof, wherein said slot in said back plate has a horizontal portion that is rectangular-parallelepiped-shaped, is disposed parallel to said lowermost horizontal edge of said back plate, extends completely through said back plate and partway into said horizontal portion of said border element, and terminates in a pair of ends, wherein said slot in said back plate further has a pair of vertical portions that are rectangular-parallelepiped-shaped, are disposed parallel to said pair of vertical edges of said back plate, respectively, extend upwardly from said pair of ends of said horizontal portion thereof, respectively, completely through said back plate and partway into said pair of vertical portions of said border element, respectively, and communicate with said channel in each vertical portion of said border element, respectively.

2. The holder as defined in claim 1, wherein said back plate is flat, thin, and generally square-shaped.

3. The holder as defined in claim 1, wherein said horizontal portion of said border element is slender, elongated, and parallelepiped-shaped.

4. The holder as defined in claim 1, wherein each vertical portion of said border element is slender, elongated, and parallelepiped-shaped.

5. The holder as defined in claim 1, wherein said channel in each vertical portion of said border element is open at said uppermost horizontal edge of said back plate so as to allow insertion of the front plate and for insertion of the sheet of material, until said horizontal portion of said border element which acts as a stop.

6. The holder as defined in claim 1, wherein said front plate is flat, thin, generally square-shaped, and transparent for allowing the sheet of material to be visible therethrough.

7. The holder as defined in claim 1, wherein said front plate is in the form of a magnifying lens.

8. The holder as defined in claim 1, wherein said front plate is tinted.

9. A holder for mounting to a surface and for interchangeably displaying a sheet of material, said holder comprising;

A) a back plate for vertical mounting to the surface and for holding the sheet of material; and B) a front plate replaceably mounted to said back plate for sandwiching the sheet of material therebetween, wherein said back plate has:

i) a rearwardmost surface for facing the surface;

ii) a forwardmost surface that faces said front plate;

iii) a pair of vertical edges that are straight;

iv) a lowermost horizontal edge that is straight; and v) an uppermost horizontal edge that is straight, wherein said back plate further has a border element that is substantially U-shaped and is disposed on said forwardmost face thereof, wherein said border element of said back plate has a pair of vertical portions that are straight, have entire lengths, and extend forwardly and continuously along said pair of vertical edges of said back plate, respectively, from said uppermost horizontal edge of said back plate to said lowermost horizontal edge of said back plate, wherein said border element of said back plate further has a horizontal portion that is straight and extends forwardly and continuously along said lowermost horizontal edge of said back plate, from one vertical portion thereof to the other vertical portion thereof, wherein each vertical portion of said border element has a channel therein that is rectangular-parallelepiped-shaped and holds said front plate and is for holding the sheet of material, and which extends said entire length thereof, is flush with said forwardmost surface of said back plate, and faces, and is aligned with, the other channel, wherein said front plate has:

I) a rearwardmost surface that faces said forwardmost surface of said back plate;

II) a forwardmost surface that extends forwardly past said border element of said back plate for facing the ambient;

III) a pair of vertical edges that are straight;

IV) a lowermost horizontal edge that is straight and abuts against said horizontal portion of said border element of said back plate; and V) an uppermost horizontal edge that is straight and aligns with said uppermost horizontal edge of said back plate, wherein each vertical edge of said front plate has:

a) an entire length; and b) a shoulder thereon that is rectangular-parallelepiped-shaped and engages in an associated channel in said back plate, and which extends said entire length thereof, is flush with said rearwardmost surface of said front plate so as to allow said front plate to lie flat on said back plate, and falls short of said forwardmost surface of said front plate, wherein the sheet of material is slid into said back plate and said front plate is slid into said back plate, by virtue of said shoulder on each vertical edge of said front plate sliding in said associated channel in said back plate, and captures the sheet of material therebetween.

10. The holder as defined in claim 9, wherein said back plate is flat, thin, and generally square-shaped.

11. The holder as defined in claim 9, wherein said horizontal portion of said border element is slender, elongated, and parallelepiped-shaped.

12. The holder as defined in claim 9, wherein each vertical portion of said border element is slender, elongated, and parallelepiped-shaped.

13. The holder as defined in claim 9, wherein said channel in each vertical portion of said border element is open at said uppermost horizontal edge of said back plate so as to allow insertion of the front plate and for insertion of the sheet of material, until said horizontal portion of said border element which acts as a stop.

14. The holder as defined in claim 9, wherein said front plate is flat, thin, generally square-shaped, and transparent for allowing the sheet of material to be visible therethrough.

15. The holder as defined in claim 9, wherein said front plate is in the form of a magnifying lens.

16. The holder as defined in claim 9, wherein said front plate is tinted.

* * * * *